US007036987B2

(12) United States Patent
Crunkleton et al.

(10) Patent No.: US 7,036,987 B2
(45) Date of Patent: May 2, 2006

(54) RECLOSABLE BAG HAVING WICKET FLAP AND SLIDER-ACTUATED STRING ZIPPER

(75) Inventors: Gregory H. Crunkleton, Nicolson, GA (US); Basil C. Linton, Loganville, GA (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 394 days.

(21) Appl. No.: 10/610,805

(22) Filed: Jul. 1, 2003

(65) Prior Publication Data

US 2004/0161172 A1 Aug. 19, 2004

Related U.S. Application Data

(63) Continuation-in-part of application No. 10/367,450, filed on Feb. 14, 2003, now Pat. No. 6,951,421.

(51) Int. Cl.
*B65D 33/16* (2006.01)

(52) U.S. Cl. ..... 383/64; 383/9

(58) Field of Classification Search ..... 383/64, 383/9, 65

See application file for complete search history.

(56) References Cited

U.S. PATENT DOCUMENTS 5,100,000 A 3/1992 Huseman
5,682,730 A 11/1997 Dobreski
6,220,754 B1 4/2001 Stiglic et al.
6,305,844 B1 * 10/2001 Bois ..... 383/64
6,361,209 B1 3/2002 LaRue et al.
6,536,951 B1 * 3/2003 Sill ..... 383/9
6,951,421 B1 * 10/2005 Crunkleton et al. ..... 383/64
2002/0034341 A1 3/2002 Bois
2002/0034344 A1 * 3/2002 Bois ..... 383/61
2003/0185468 A1 * 10/2003 Keith et al. ..... 383/9
2004/0161167 A1 * 8/2004 Ausnit et al. ..... 383/5
2005/0008267 A1 * 1/2005 Linton et al. ..... 383/61.2

FOREIGN PATENT DOCUMENTS

WO WO 03/082691 A1 10/2003

* cited by examiner

*Primary Examiner*—Jes F. Pascua
(74) *Attorney, Agent, or Firm*—Ostrager Chong Flaherty & Broitman P.C.

(57) ABSTRACT

A reclosable bag having a top flap with holes configured to allow a stack of such bags to be mounted on a wicket or a pair of dispensing posts, and having a slider-actuated zipper (e.g., a string zipper) installed in a mouth at the top of the bag. The top flap is connected to a double layer of film that forms one side of the receptacle mouth and is joined to one strip of the zipper. The flap, which extends downward near its connection to the double layer of film, can be wrapped under and around the bottom of one side of the slider. The holes in the flap (for the wicket) are disposed above the zipper when the wrapped-around flap is fully extended upward.

27 Claims, 6 Drawing Sheets

RECLOSABLE BAG HAVING WICKET FLAP AND SLIDER-ACTUATED STRING ZIPPER

RELATED PATENT APPLICATION

This application is a continuation-in-part and claims priority from U.S. patent application Ser. No. 10/367,450 filed on Feb. 14, 2003 and entitled "Reclosable Packaging Having Slider-Operated String Zipper", now U.S. Pat. No. 6,951,421.

BACKGROUND OF THE INVENTION

This invention generally relates to reclosable bags having slider-actuated plastic zippers. In particular, the invention relates to slider-actuated reclosable bags having a header or flap with holes or slits for mounting a stack of bags on a wicket.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags generally comprise a receptacle having a mouth with a plastic zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

In a specific application, reclosable bags are commonly used by deli clerks in grocery stores to package cheese and deli meats sold to consumers. To facilitate handling of the reclosable bags by the deli clerks, the bags often include a header having one or more holes for mounting a stack of bags to one or more dispensing posts. The reclosable bags are typically mounted to the dispensing posts in bag packs consisting of a predetermined number of bags. The dispensing posts may, e.g., take the form of a U-shaped wicket wherein the legs of the U-shaped wicket penetrate respective holes formed in the header of each bag. The header may take the form of a top header extending upward from the zippered mouth of the bag or a bottom header extending downward from the bottom of the bag.

U.S. Pat. No. 5,682,730 discloses a plurality of plastic bags formed into unitary packs for shipping and loading onto dispensing posts. This is done by stacking the bags and then assembling them into a unitary pack by penetrating the stack with a heated or ultrasonic pin or punch element to form apertures. The bags in the pack are heat-welded or ultrasonically welded together along the periphery of the apertures. To maintain the integrity of the bag pack during shipping, the bag is mounted to dispensing posts in the form of a wicket prior to shipment.

More specifically, U.S. Pat. No. 5,682,730 discloses a reclosable bag having a bottom header with two holes for mounting the plastic bag to a pair of dispensing posts. The holes are spaced apart along a lateral line running generally parallel to the zipper. The bottom header includes a line of perforations that allows the bag to be torn away from the header after the bag has been filled with product. The embodiment illustrated in U.S. Pat. No. 5,682,730 has a bottom header that includes a pair of opposing header panels connected by a fold. The fold forms a primary bottom, while a seal line of thermal fusion forms a secondary bottom at the junction of the receptacle and the header. This patent further states that one of the header panels can be eliminated. The top of the bag U.S. Pat. No. 5,682,730 has a slider-actuated zipper. The zipper comprises two profiled zipper parts that have respective fins or flanges thermally fused to the inner surfaces of the receptacle panels.

An alternative to the aforementioned flanged zipper design is the so-called flangeless or string zipper, which has substantially no flange portions above or below the interlockable zipper strips. In the case of a string zipper, the bag making film is joined to the backs of the bases of the zipper strips. String zippers can be produced at much greater speeds, allow much greater footage to be wound on a spool, thereby requiring less set-up time, and use less material than flanged zippers, enabling a substantial reduction in the cost of manufacture and processing.

U.S. patent application Ser. No. 10/367,450 discloses a reclosable bag in which respective marginal portions of the bag film are sealed to the backs of respective flangeless zipper strips and in which the resulting string zipper is actuated by means of a slider.

There is a continuing need for new designs of wicketed reclosable bags that can be manufactured at low cost. There is also a need for such a low-cost bag that has a top header instead of a bottom header for hanging the bag on a wicket or on dispensing posts.

BRIEF DESCRIPTION OF THE INVENTION

The present invention is directed, in part, to a reclosable bag having a top flap with holes configured to allow a stack of such bags to be mounted on a wicket or a pair of dispensing posts, and having a slider-actuated zipper (e.g., a string zipper) installed in a mouth at the top of the bag. The top flap is connected to a double layer of film that forms one side of the receptacle mouth and is joined to one strip of the zipper. The flap, which extends downward near its connection to the double layer of film, can be wrapped under and around the bottom of one side of the slider. The holes in the flap are disposed above the zipper when the wrapped-around flap is fully extended upward. The invention is further directed to a method of manufacturing such bags.

One aspect of the invention is a reclosable bag comprising: a zipper comprising first and second zipper strips, the first zipper strip comprising a first base and a first closure profile projecting from the first base, and the second zipper strip comprising a second base and a second closure profile projecting from the second base and engaged with the first closure profile; a film structure made of a film material, the film structure comprising first and second portions integrally connected to one side of a third portion, the third portion being a double layer of the film material, and the first and second portions each being a respective single layer of the film material, the first zipper strip being joined to the first portion of the film structure, and the second zipper strip being joined to the third portion of the film structure; and a slider mounted on the zipper and movable in opposite directions for opening and closing the zipper. At least part of the third portion of the film structure is disposed between the second base of the second zipper strip and one side of the slider.

Another aspect of the invention is a reclosable bag comprising: a receptacle comprising first and second walls joined at their sides, the first and second walls comprising respective upper marginal portions that form a mouth at a top of the receptacle; a string zipper comprising mutually interlockable first and second zipper strips respectively joined to the upper marginal portions of the first and second walls; a slider mounted on the string zipper and movable in opposite directions for opening and closing the string zipper, the upper marginal portion of the first wall being disposed between the first zipper strip and a first portion of the slider, and the upper marginal portion of the second wall being disposed between the second zipper strip and a second portion of the slider; and a web comprising a first portion joined with at least the upper marginal portion of the first wall and disposed, at least in part, between the first zipper strip and said first portion of the slider, and a second portion that is integrally formed with and extends from the first portion of the web without being joined to any other part of the bag, the second portion of the web extending downward in immediate proximity to where the first and second portions of the web are integrally formed and having sufficient length to wrap around a bottom edge of the first portion of the slider to a position whereat a distal edge of the second portion of the web is disposed at an elevation higher than the bottom edge of the first portion of the slider.

A further aspect of the invention is a method of manufacturing a reclosable bag, comprising the following steps: (a) folding a web of bag making film to form a first folded portion, with a first portion of the web being disposed in opposition to a second portion of the web, the first portion of the web being connected to the first folded portion by a third portion of the web, and the second portion of the web being connected to the first folded portion by a fourth portion; (b) folding the web of bag making film to form a second folded portion, with a fifth portion of the web being disposed in opposition to the second portion of the web; (c) joining the back of a first flangeless zipper strip to the first portion of the web; (d) joining the second portion of the web to a back of a second flangeless zipper strip and to the fifth portion of the web; and (e) inserting a slider on the string zipper.

Yet another aspect of the invention is a method of manufacturing a reclosable bag, comprising the following steps: (a) arranging and sealing film material to form a receptacle and a flap joined to the receptacle, the receptacle having an interior volume and a mouth for accessing the interior volume, and the flap extending beyond a boundary of the receptacle where the mouth is located; (b) prior to completion of the receptacle, joining opposing portions of the film material, that will form the mouth of the receptacle, to respective backs of first and second flangeless zipper strips; (c) aligning the first and second flangeless zipper strips with each other; and (d) after steps (b) and (c), mounting a slider onto the aligned first and second flangeless zipper strips with respective portions of the opposing portions of the film material being disposed between respective side walls of the slider and respective backs of the first and second flangeless zipper strips.

A further aspect of the invention is a reclosable bag comprising: a receptacle made of a film material and having a mouth comprising first and second sides, the first side of the mouth consisting of a double thickness of the film material; a zipper comprising first and second zipper strips respectively joined to the first and second sides of the mouth; a slider mounted on the zipper and movable in opposite directions for opening and closing the zipper; and a flap connected to the first side of the mouth of the receptacle and made of a single thickness of the film material, the portion of the flap adjacent the connection with the first side of the mouth extending downward and the flap having a length sufficient to allow the rest of the flap to be wrapped around at least the bottom of one side of the slider. The flap comprises a discontinuity and a line of weakened tear resistance that traverses an area disposed between the discontinuity and the connection with the first side of the mouth.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
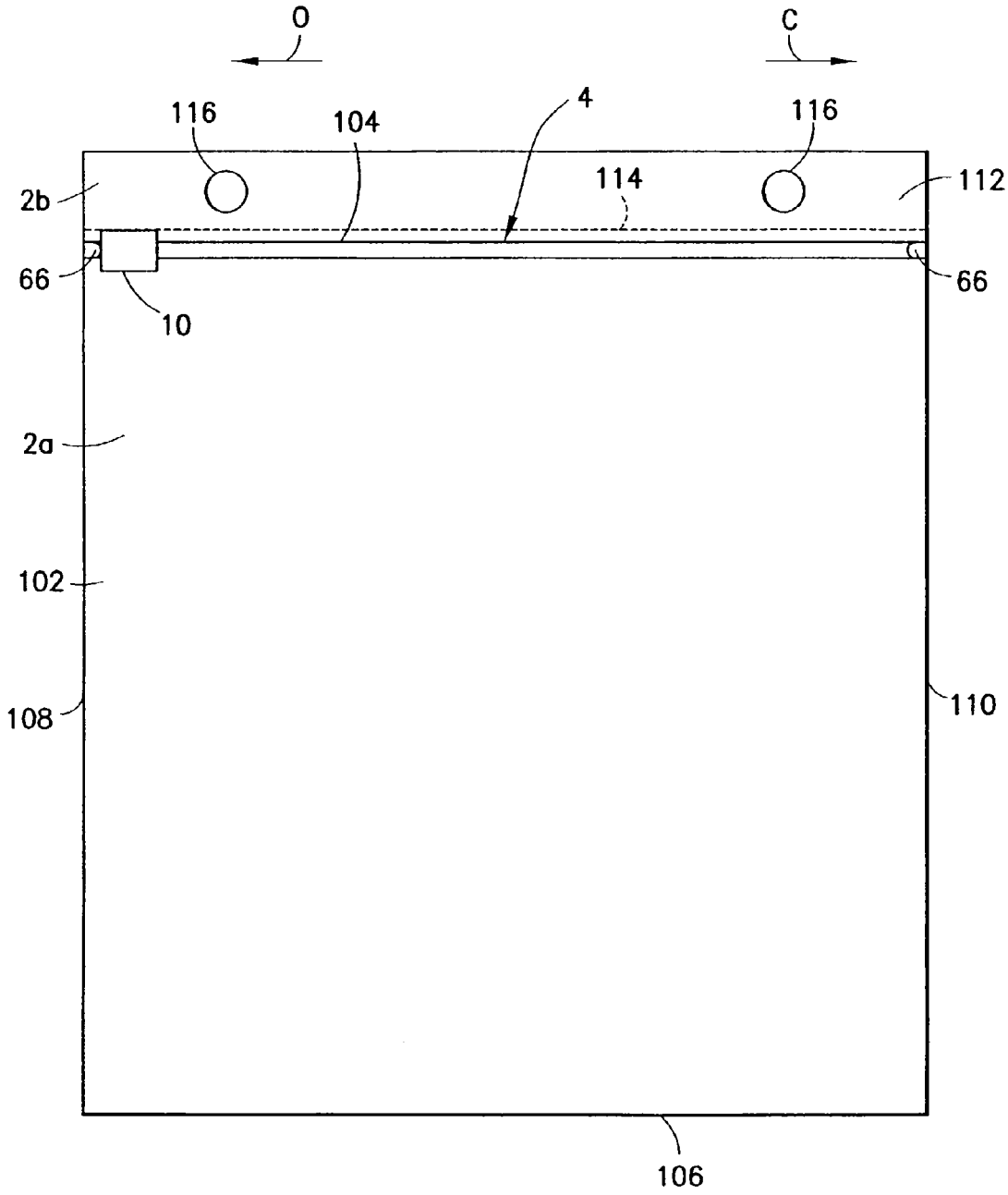
FIG. 1 is a drawing showing a front view of a reclosable bag in accordance with one embodiment of the present invention. For the purpose of this illustration, it has been assumed that the bag film is optically transparent, so that the string zipper is visible behind a layer of film.

A reclosable bag in accordance with one embodiment of the invention is shown in FIG. 1. The bag comprises a receptacle 102 made of a bag making film. The receptacle 102 has a mouth at a top 104 and is closed along a bottom 106 and two sides 108, 110. More specifically, the receptacle 102 comprises front and rear walls (2*a* and 2*b* in FIG. 2) joined at the bottom 106 by a fold and at the sides 108, 110 by respective heat seals. A string zipper 4 is installed in the mouth of the receptacle. The string zipper 4 comprises a pair of interlocked zipper strips joined at their ends by respective seals 66 (formed, e.g., by application of heat and pressure or ultrasonic wave energy). String zipper 4 is actuated by a slider 10. The string zipper 4 is opened when the slider 10 is moved in the direction of the arrow O and closed when the slider 10 is moved in the direction of the arrow C. The end stops 66 prevent the slider from sliding off the end of the zipper when the slider reaches the zipper closed or fully opened position.

The bag depicted in FIG. 1 further comprises a flap 112 that extends upward from a starting point behind the string zipper 4. The flap 112 is a rectangle having a length equal to the width of the receptacle 102. The flap 112 has a line of weakened tear resistance or tear line (represented by a dashed line designated by the numeral 114 in FIG. 1) that extends along substantially the entire length of the flap 112 in parallel with and spaced apart from the string zipper 4. The tear line 114 may comprise a line of spaced perforations, a scoreline, or any other functionally equivalent structure. Although not shown, a tear notch may be formed in the flap at one or both ends of the tear line 114 to facilitate tearing along the tear line. In addition, the flap 112 has a pair of circular holes 116 which are spaced apart along a line running generally parallel to the tear line 114. These holes are used to mount each bag on a pair of posts or wicket legs (not shown in FIG. 1) to form a stack. Slits can be used instead of holes.

Figure 3:
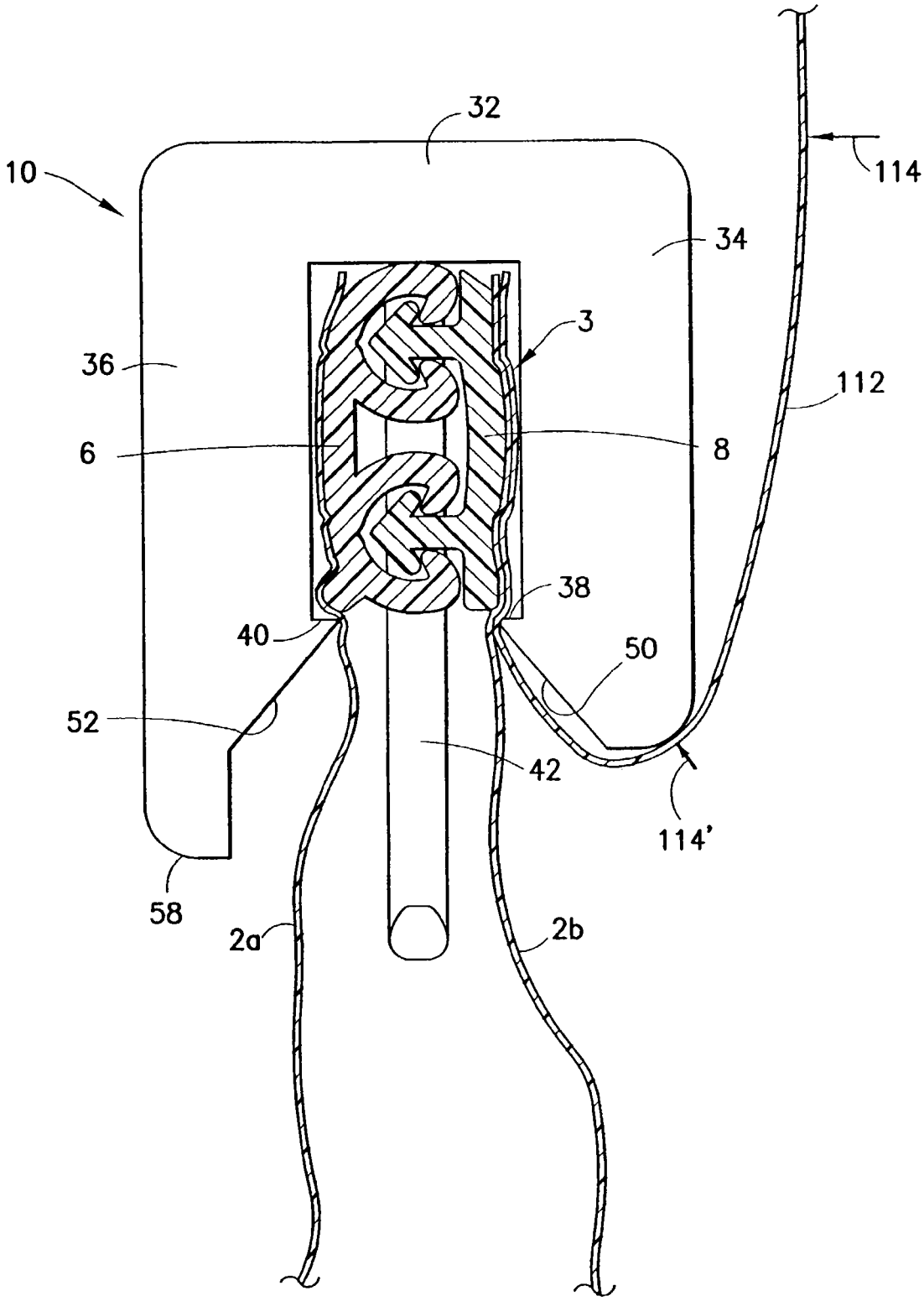
FIG. 3 is a drawing showing a fragmentary sectional view of a slider-string zipper assembly incorporated in the bag depicted in FIG. 1. The zipper and bag film are shown sectioned in a plane in front of the closing end of the slider.

Bags of the type depicted in FIG. 1 are typically manufactured on a machine. At the end of the production line, when each finished bag comes off the machine, each finished bag is carried and placed over a pair of posts. A predetermined number of bags are placed on the posts to form a stack. The filled posts are then moved and replaced by another set of posts having no bags stacked thereon. The stack of bags is then lifted manually or automatically off of the posts and while the holes are still aligned, the parallel legs of a U-shaped wicket made of wire are passed through the holes. The stack of bags is secured on the wicket and then placed inside a box for shipment, e.g., to a grocery store. In use, the bags are filled with product manually, as depicted in FIG. 3 of U.S. Pat. No. 5,682,730. Then the open top of the bag is closed by manipulation of the slider. Finally, the filled bag is removed from the stack by tearing the bag along the tear line, thereby severing the filled bag from the flap remnant that remains mounted to the wicket.

Alternatively, the bags can be sealed to each other by ultrasonic pins during the process of forming holes for dispensing posts.

Figure 2:
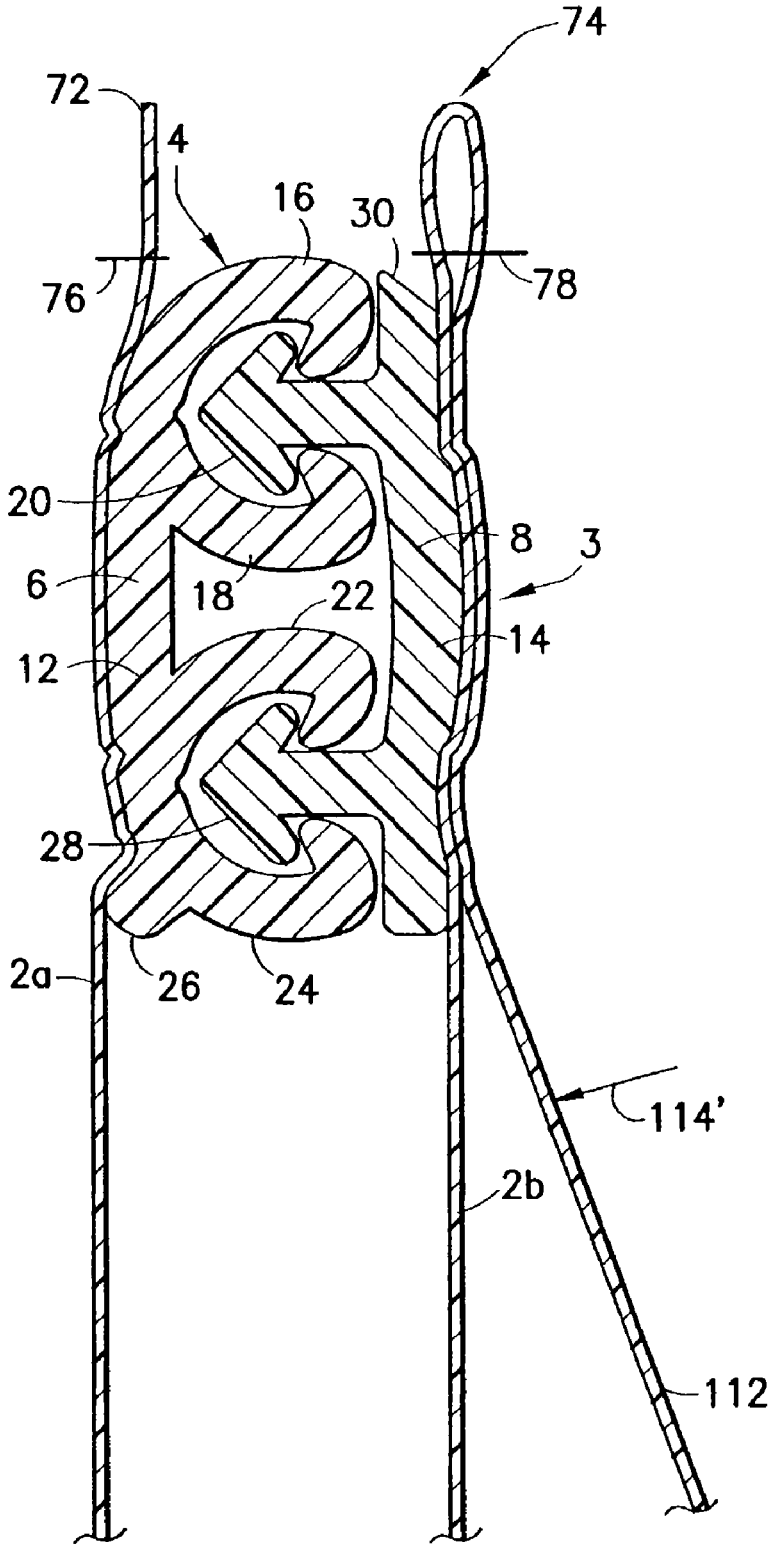
FIG. 2 is a drawing showing a fragmentary sectional view of a string zipper joined to a folded web at an intermediate stage (prior to trimming) in a manufacturing process in accordance with one embodiment of the invention.

In the embodiment depicted in FIG. 1, both the receptacle 102 and the flap 112 are formed from a single web of bag making film of uniform thickness that is folded and heat sealed, as explained in detail below. FIG. 2 depicts an intermediate stage in the manufacture of the bag depicted in FIG. 1. The web of film is folded in two places. Only one fold 74 is shown in FIG. 2. However, it should understood that there is another fold at the bottom of the receptacle that connects the front wall 2*a* to the rear wall 2*b*, both of which are cut off in FIG. 2 in order to maintain a satisfactory scale. The depiction of flap 112 is also cut off in FIG. 2 (as well as in FIG. 3), but it should be understood that the flap may have sufficient length so that its distal edge attains the position depicted in FIG. 1, with the tear line 114 being located at an elevation higher than that of the zipper 4, and with the holes 116 disposed above the tear line 114.

In one method of manufacture, a web of film is perforated or scored to form a line of weakened tear resistance or tear line along the length of the web. The web of film is then folded along a line that is off-center, leaving one side of the folded web longer than the other side, with the tear line being located on the longer side. The longer side of the folded web is then folded back along a line that is located approximately directly across from the edge of the shorter side of the folded web, creating a serpentine web profile. That second fold line is designated by the numeral 74 in FIG. 2. The first two legs of the profile are approximately equal in height, while the third leg is shorter than the other two. This third leg will ultimately be wrapped around the slider disposed generally vertically to form the upwardly projecting flap 112 seen in FIG. 3. Initially however, the third leg may extend generally downward in the manner depicted in FIG. 2. The tear line is formed in the web at a location such that the tear line is located on the flap 112. FIG. 3 shows two possible locations for the tear line, which locations are indicated by respective arrows designated 114 and 114'. However, the tear line may be located anywhere on the section of flap between the holes 116 (see FIG. 1) and the area where the flap 112 connects to the receptacle.

In accordance with one embodiment of the invention, a string zipper, comprising a pair of zipper strips 6 and 8 having complementary profiles, is inserted between opposing portions of the first and second legs of the folded web and near an edge. 72 (see FIG. 2) of the web. The zipper is joined to the web of film by conventional conductive heat sealing using heated sealing bars placed on opposing sides of the assembly. The sealing bars form band-shaped zones of joinder. During this sealing operation, a portion of the first leg of the folded web is sealed to the back of the zipper strip 6, while a portion of the second leg and a portion of the third leg are pressed together and sealed to the back of the zipper strip 8, as shown in FIG. 2. This sealing operation causes the second and third legs of the film structure to merge, forming a double layer 3 of film material joined to the back of the flangeless zipper strip 8.

FIG. 2 depicts the case wherein an unsealed distal portion of wall 2*a* extends beyond the zipper strip 6, while an unsealed loop of film at the fold 74 extends beyond the zipper strip 8. These excess pieces of film are later trimmed off by cutting knives symbolically represented by lines 76 and 78, respectively. The configuration of the zipper-film assembly after the cutting operation can be seen in FIG. 3. The upper margins of the bag walls may have short free ends that extend beyond the termination points depicted in FIG. 3, provided that the free ends are not so long as to interfere with travel of the slider along the zipper or become entangled with the zipper profiles. Alternatively, the distal edge of wall 2*a* and the fold 74 may be sufficiently aligned with the zipper strips 6, 8 so that no trimming is necessary.

The zipper strips 6 and 8 are formed by extruding a plastic material. The preferred material is polyethylene or polypropylene. The zipper strip 8 comprises a base 14 and two generally arrow-shaped rib-like male closure elements or members 20 and 28 projecting from base 14, while zipper strip 6 comprises two pairs of hook-shaped gripper jaws 16, 18 and 22, 24 connected by a sealing bridge or base 12. The pairs of gripper jaws 16, 18 and 22, 24 form respective complementary female profiles for receiving the male profiles of closure elements 20 and 28. The sealing bridge 12 and the base 14 are resiliently flexible self-supporting structures having a thickness greater than the thickness of the bag film. The male closure elements are integrally formed with the base 14, while the female closure elements are integrally formed with the sealing bridge 12.

The end face of upper edge 30 of the base 14 that carries the male closure elements 20 and 28 is inclined at about a 45° angle to facilitate loading of the slider onto the zipper from above without snagging on a corner of the upper edge. The bottom edge of the base 14 cooperates with a retaining ledge on the slider (to be described later) to increase the slider pull-off resistance. For the same purpose, a rib 26 is formed on zipper strip 6, the rib 26 cooperating with a retaining ledge on the other side of the slider.

To open the closed zipper, the zipper strips 6 and 8 are pushed apart with sufficient force by the slider plow (item 42 in FIG. 3) to pry the heads of the male members out of the female profiles. When the shoulders of the male members clear the hooks of the outwardly flexed gripper jaws, the male and female members are no longer interlocked and the zipper is open.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile. In addition, although FIGS. 2 and 3 show a rib-and-groove arrangement, the profiles of the zipper strips may take any form. For example, either string zipper may comprise alternating hook-shaped closure elements.

Nor is the invention limited to having two female profiles on one zipper strip and two male profiles on the other zipper strip. In the first place, the string zipper could have one complementary set of male and female profiles, or it could have more than two complementary sets of male and female profiles. Furthermore, in the case of two complementary sets of male and female profiles, one zipper strip could have one male profile and one female profile, while the other zipper strip has one female profile and one male profile. Other variations should be apparent to persons skilled in the art of resealable packaging.

After the zipper has been joined to the film structure and the film (if necessary) has been trimmed, a slider is inserted on the zipper-film assembly as seen in FIG. 3. The slider 10 is generally shaped so that the body of the slider (exclusive of the plow) straddles the zipper profiles. The upper margin of wall 2*a* of the film web (which is a single layer of film) is joined to the back of the zipper strips 6 and thus passes through the interstices between zipper strip 6 and the confronting side wall of the slider. On the other side of the zipper, the merged double layer 3 of film material is joined to the back of the zipper strip 8 and thus passes through the interstice between the zipper strip 8 and the other side wall of the slider. The part of the third portion of the film structure that is not joined to the second portion forms the flap 112, which extends downward in proximity to its connection with the double layer 3 of film material, but is otherwise free to be wrapped under and around the adjacent side wall of the slider, as seen in FIG. 3. The flap 112 is sufficiently long that it forms a header that extends above the zipper line (as seen in FIG. 1) when extended in a generally upward vertical direction. In FIG. 3, the complete flap is not shown to facilitate fitting this relatively large scale drawing on one sheet.

The slider 10 shown in FIG. 3 is more fully disclosed in U.S. patent application Ser. No. 10/367,450. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by a pair of substantially planar, inclined interior surfaces (not visible in FIG. 3), which converge toward the closing window of the slider. The inclined surfaces funnel or squeeze the zipper strips toward each other, causing the zipper profiles to interlock, as the slider is moved in the closing direction. The side walls 34 and 36 are formed with concave curved indentations where the user may place the tips of an index finger and a thumb for gripping the slider. Alternatively, convexities (e.g., ribs) could be formed on the sides of the slider to facilitate grasping.

The slider 10 also comprises a plow or divider 42 that depends downward from a central portion of the top wall 32 to an elevation below the lowermost portions of each side wall. The plow partitions the tunnel inside the slider and is disposed between opposing sections of the zipper strips that pass through the tunnel. The tip of the plow 42 is truncated and has rounded edges and flattened comers at opposing ends for facilitating insertion of the plow between the zipper profiles without snagging.

The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper strips 6 and 8 apart. The plow 42 divides the opening end of the slider tunnel into respective passages for the separated zipper strips to pass through.

As partly seen in FIG. 3, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper strips to increase slider pull-off resistance. For improved gripping, the upper surfaces of the retaining ledges may be angled upward toward the distal edge.

The ledges 38 and 40 further comprise respective inclined bottom surfaces 50 and 52 that extend downward and outward from the respective inner edges of the generally horizontal surfaces. The inclined surfaces 50 and 52 are each substantially planar, with the respective planes of these inclined surfaces intersecting at a line inside the tunnel that is generally parallel to the longitudinal axis of the slider. The inclined surfaces 50 and 52 serve to guide the respective zipper strips 6 and 8 into the slider tunnel during insertion of the slider onto the zipper. The sliders are typically inserted at spaced intervals onto a zipper-film assembly that is being intermittently advanced in a machine direction by automated slider insertion equipment.

The generally horizontal surfaces of the retaining ledges latch under the zipper profiles and assist in retaining the slider on the zipper, while the inclined bottom surfaces of the retaining ledges assist in slider insertion onto the zipper by guiding or funneling the respective zipper strips into the slider passageway, including the passages on opposing sides of the plow.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS. To reduce the cost of manufacture, the slider may be designed to reduce the amount of material used and to increase the speed with which such sliders can be injection molded. Suitable injection-molded slider designs are fully disclosed in U.S. patent application Ser. No. 10/412,438.

Figure 4:
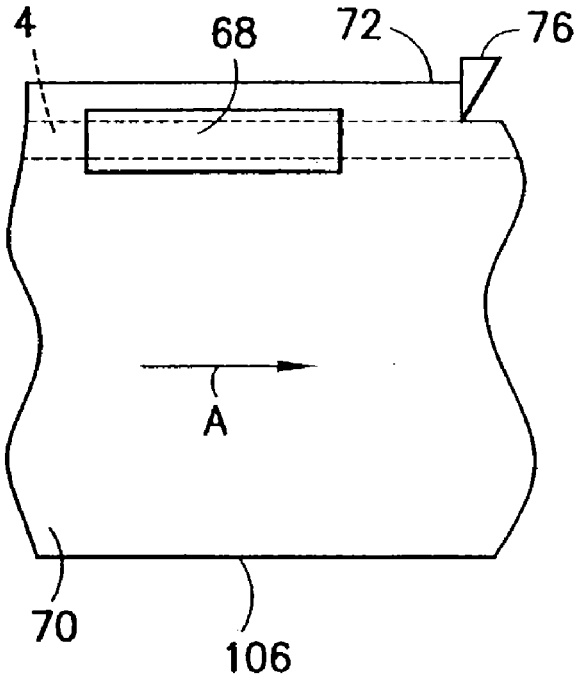
FIG. 4 is a drawing showing a top view of a continuous-movement section of an automated production line for manufacturing the bag depicted in FIG. 1. The zipper-film assembly shown in FIG. 4 is advanced from left to right, as indicated by arrow A.
Figure 5:
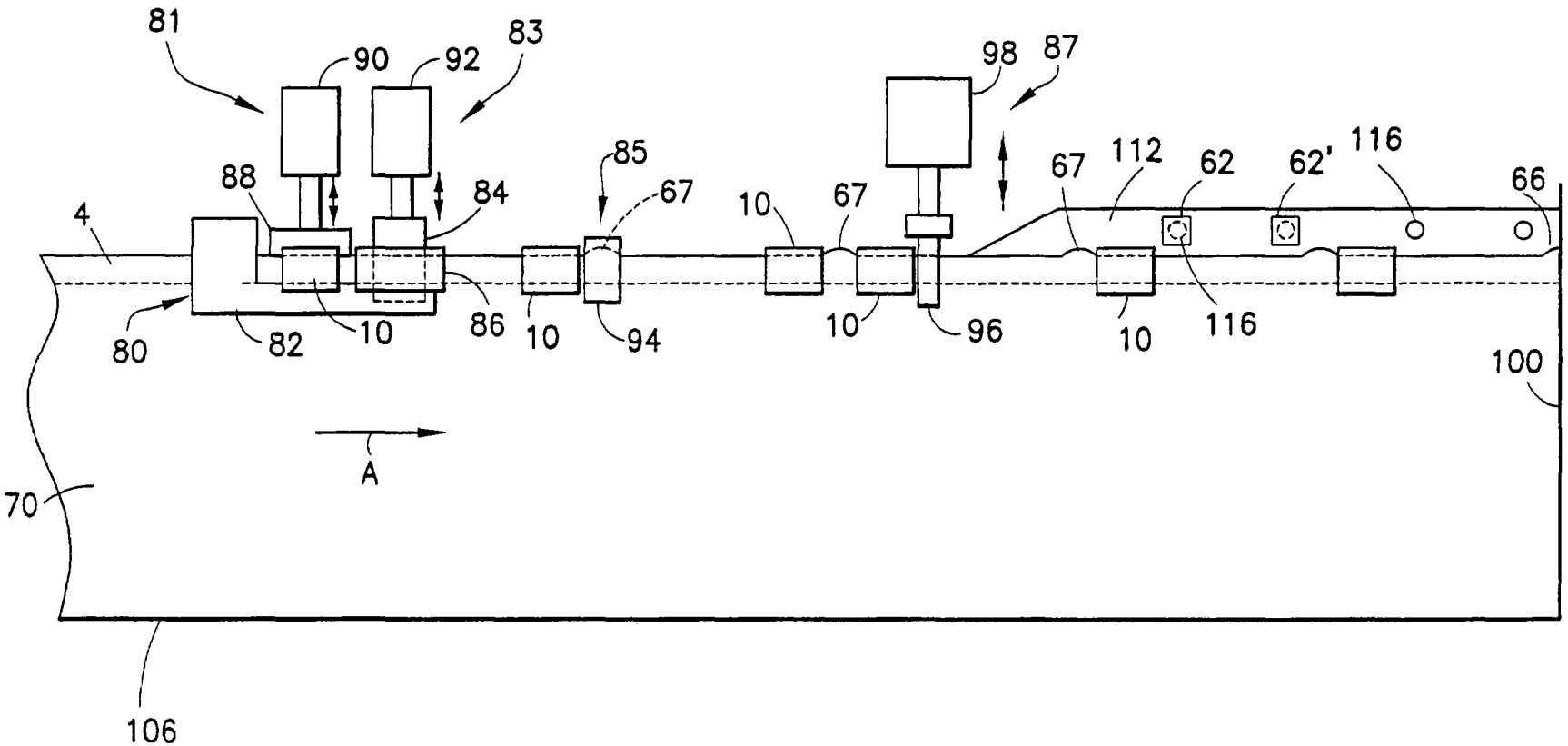
FIG. 5 is a drawing showing a top view of an intermittent-movement section of the aforementioned production line, which section follows the continuous-movement section depicted in FIG. 4. It should be appreciated that the sizes of the zipper, sliders, humps, and holes, relative to the size of the packages being made, are exaggerated for the purpose of illustration (in FIG. 4 as well).

Reclosable packages of the type depicted in FIG. 1 can be manufactured on an automatic production line. An exemplary production line is shown in FIGS. 4 and 5. FIG. 4 shows a section of the production line in which the zipper strips and bag making film move continuously. FIG. 5 shows a further section in which the zipper strips and bag making film move intermittently. The continuous movement in the section shown in FIG. 4 is converted to intermittent movement in the section shown in FIG. 5 by a conventional dancer assembly (not shown). However, a person skilled in the art will readily appreciate that operations performed in the continuous-movement section could also be performed on a section of web being moved intermittently.

The operations performed continuously during continuous advancement include: perforating a web of film along a line parallel to the machine direction, folding the web of film; sealing a string zipper to opposing portions of the folded web; and trimming excess film by cutting the film at an elevation above the zipper-film seals.

The operations performed during dwell times in the intermittent-movement section include: inserting sliders on the zipper; forming slider end stops at spaced intervals along the zipper; forming pairs of holes in the flap at spaced intervals (see holes 116 in FIG. 1); and cutting the zipper-film assembly with a hot knife that both seals and severs to form a separate package. Other operations are performed during intermittent advancement of the zipper-film assembly. For example, during each advancement, a new section of zipper is pried open by a stationary separator assembly at a point upstream of the slider insertion zone. In addition, downstream of the slider insertion zone, a previously inserted slider is held stationary while the zipper-film assembly moves relative thereto, such relative movement of the slider closing a corresponding section of the string zipper. The transition from continuous advancement of the film to intermittent advancement of the film is accomplished by a conventional dancer assembly. The foregoing operations will now be described in more detail with reference to FIGS. 4 and 5.

FIG. 4 shows a portion of a web 70 of bag making film after the web has been unwound from a roll (not shown) and then passed over two different folding boards or plows (not shown) that fold the web into a serpentine configuration having respective folds at opposing ends of the middle section of film. The folded web is pulled through by conventional guide and drive rollers (not shown). In FIG. 4, the numeral 106 designates the fold in the web of film that becomes the bottom of the bag. The line that would normally indicate the fold line proximal to the string zipper is located behind the edge 72 of the folded web and therefore is-not shown in FIG. 4. The folds lie along lines that are generally parallel to the edges of the web, which are also mutually parallel. Part of the portion of the folded web that extends downward from the second (upper) fold line will later be folded to form the wicket flap (item 112 in FIG. 1), as described in detail hereinafter. The portion of the web 70 shown in FIG. 4 advances continuously in the direction indicated by arrow A.

Although not shown in FIG. 4, a line of spaced perforations is formed in the web, preferably prior to folding. The line of perforations is placed on the unfolded web in a lateral position such that after folding, the perforations lie on the third leg (not visible in FIG. 4) of the serpentine folded web. The perforations are made by a perforator (not shown) as the web advances continuously. Other means (such as a scoring device) for forming a line of weakness could also be used.

A string zipper 4, comprising a pair of interlocked flangeless zipper strips, is unwound from a reel (not shown), fed at an angle between the upper portions of the first and second legs of the folded web 70, and guided into a position (shown in FIG. 4) parallel to the machine direction. At a zipper sealing station, these marginal portions of the film are joined to the respective backs of the zipper strips by a pair of mutually opposing conventional heated sealing bars 68 (only one of which is visible in FIG. 4). As previously described, the third leg of the web is disposed between the second leg and the confronting sealing bar during the sealing operation, so that a portion of the third leg is merged with that portion of the second web which is joined to the back of the zipper strip. The end result of this sealing operation is shown in FIG. 2. On one side, a single layer of film is joined to the back of zipper strip 6; on the other side a double layer 3 of film is joined to the back of zipper strip 8. Although. FIGS. 2 and 3 depict two distinct layers joined together, this is for illustrative purposes only, and it should be appreciated that the merged plastic layers will not have a distinct interface such as is shown in the drawings.

The zipper sealing station is conventional apparatus and is described hereinafter only briefly. As the folded web 70 with inserted string zipper 4 advances continuously between the opposing sets of sealing bars 68, the respective zipper strips have their backs sealed to the opposing upper marginal portions of the bag making film, thereby continuously attaching incoming sections of the moving string zipper to adjoining sections of the moving web. The sealing is accomplished by electrically heating the sealing bars 68, the heat being conducted through respective endless barrier strips (not shown) made of Teflon or similar material, which circulate on respective sets of rollers (not shown). Each Teflon barrier strips passes between a respective side of the folded web and a respective sealing bar In the gaps between the opposing sealing bars, the web and string zipper are sandwiched between and held together by the Teflon barrier strips, which move with the web and zipper and prevent the bag making film from sticking against the stationary heated sealing bars during conduction heat sealing. The Teflon barrier strips and intervening web and zipper pass through the nips of a series of guide rollers (not shown).

Downstream from the zipper sealing station, the excess film adjacent the string zipper is continuously trimmed by a pair of stationary knives, symbolically depicted by lines 76 and 78 in FIG. 2. Knife 76 is depicted as a triangle in FIG. 4. Each knife trims a respective portion of the film that extends beyond the zones of web-to-zipper strip joinder. As seen in FIG. 2, knife 76 trims the marginal portion at the edge 72 of the web, while knife 78 trims the folded edge 74. The cutting lines should be located close enough to the respective zipper strips 6 and 8 so that the remnants of film projecting above the zipper are not long enough to interfere with operation of the slider as it moves along the zipper.

The trimmed zipper-film assembly then wends its way through a conventional dancer assembly, which converts the continuous advancement of the film into intermittent advancement of the film. In the intermittent advancement phase, the zipper-film assembly is moved one package increment and then stopped for a period of time, i.e., the dwell time. This cycle is repeated.

Referring to FIG. 5, at the first station after the dancer assembly, the slider 10 (or other slider, such as slider 70 shown in FIG. 4) is inserted onto the zipper-film assembly. The slider insertion station comprises three assemblies (namely, a separator assembly, a pusher assembly and a clamping assembly) that cooperate to insert the slider on the zipper while the zipper is being held open on both sides of the slider insertion zone.

Upstream of the slider insertion zone, a separator assembly 80 disengages the strips of string zipper 4 while the zipper-film assembly is advanced one package length. The separator assembly 80 comprises a central splitter plate separated by gaps from upper and lower guides disposed above and below the splitter plate. Only the upper guide 82 of the separator assembly is visible in FIG. 5. The upper and lower guides hold the respective strips of zipper 72 in respective grooves formed in the splitter plate (not shown). Thus, as the zipper-film assembly is pulled through the bag making machine (by conventional means not shown), the splitter plate will pry open successive package-length sections of zipper during successive zipper-film advancements.

In the slider insertion zone, a pusher assembly 81 comprises a pusher 88 that pushes a slider 10 onto the zipper 72. The pusher 88 is extended by actuation of an air cylinder 90. When the pusher 88 is retracted, the next slider must be automatically fed to a pre-insertion position directly in front of the pusher. This is accomplished by a conventional pneumatic slider feeding system (not shown).

The upper and lower guides of the separator assembly 80 further comprise respective blades that extend in cantilevered fashion into the slider insertion zone, as taught in U.S. patent application Ser. No. 10/436,433 entitled "Method and Apparatus for Inserting Sliders During Automated Manufacture of Reclosable Bags". These blades are disposed to brace the respective zipper strips against deflection as the slider 10 is pushed onto the zipper.

Downstream of the slider insertion zone, the zipper is clamped by a clamping assembly 83 comprising a retractable separator plate 84 that is interposed between the strips of an open section of the zipper 72. The clamping assembly 83 further comprises upper and lower zipper clamps that clamp the zipper strips against the extended separator plate 84. Only the upper zipper clamp 86 is visible in FIG. 5. The separator plate 84 is extended by actuation of an air cylinder 92. Following extension of the separator plate 84, the upper and lower zipper clamps are extended by actuation of respective air cylinders that are not shown in FIG. 5.

Thus, the upper and lower guides of the separator assembly 80, and the upper and lower clamps of the clamping assembly 83 serve to stabilize the zipper during slider insertion. The interposition of the splitter plate (not shown in FIG. 5) and the separator plate 84 between the zipper strips upstream and downstream, respectively, of the slider insertion zone means that the zipper is maintained in an open state, with a gap between the zipper strips, in the zone where the slider is inserted. The zipper strips are held in respective positions such that the slider plow 42 (see FIG. 2) enters the gap between the zipper strips and then the slider side walls respectively pass over the zipper strips during slider insertion. The slider is pushed onto the zipper until the retaining ledges on the slider interior latch under the zipper strips to hold the slider securely on the zipper.

During the same dwell time that a slider is being inserted, a slider end stop structure 67 is being formed on the zipper at an ultrasonic stomping station downstream from the slider insertion device. This slider end stop structure 67 will be bisected later during cutting by a hot knife 100 to form two slider end stops 66 (see FIG. 1), i.e., the end stop at the zipper fully closed slider park position for one package and the end stop at the zipper fully open slider park position for the next package. The end stop structure 67 is formed by an ultrasonic stomping assembly 85 comprising a horn 94 and an anvil (not shown in FIG. 5). The horn 94 transmits sufficient ultrasound wave energy into that plastic zipper material that the plastic is fused into a structure (e.g., a vertically extending hump) defined by the surfaces of the horn and anvil. The horn and anvil may be of the reciprocating or rotary variety.

After each dwell time, the zipper-film assembly is advanced. During each intermittent advancement, a slider stopper assembly 87 restrains a slider 10 so that a respective section of zipper is closed. The slider stopper assembly 87 comprises a stopper element 96 coupled to an air cylinder 98. The stopper element 96 is movable from a retracted position to an extended position by actuation of the air cylinder 98. The stopper element 96 is in its extended position when the advancement of the zipper-film assembly begins. In this extended position, the stopper element 96 interferes with the slider and blocks it from advancing with the zipper. This causes a displacement of the slider relative to the zipper in a zipper closing direction, thereby closing a section of zipper. Before the advancement of one package length is completed, the stopper element 96 is retracted, which allows the slider to advance past the retracted stopper element.

At a point downstream of the slider stopper assembly 87, the third leg is wrapped around the proximal slider and folded to form the flap 112. During each dwell time, other ultrasonic apparatus forms a pair of holes 116 in the most recently folded section of the flap 112. For example, a pair of ultrasonic horns 62 and 62' are designed to form respective pairs of circular holes 116 in each package length section of the flap 112. The anvils that cooperate with horns 62 and 62' are not shown in FIG. 5. Alternatively, holes or slits could be made using suitably shaped cutters or punches.

In addition, during each dwell time, a hot cutting knife 100 (which may comprise a solitary blade or a pair of opposed blades) cuts and forms side seals in the film on both sides of the cut, thereby severing a bag (not shown in FIG. 5) from the remainder of the web 70 on the bag making machine. Each bag is then placed so that the holes 116 in the wicket flap 112 align with and are penetrated by a pair of posts. Each successive bag takes its place atop the stack of bags mounted to the posts until a predetermined maximum number of bags is achieved. Then the stack is removed from the posts and a wicket is inserted into the aligned holes, these steps being typically performed either manually or automatically. A stack of wicketed slider bags can be used to package produce, deli meats, or other products.

A reclosable bag having the structure depicted in FIG. 3 can be manufactured using methods other than those described with reference to FIGS. 4 and 5. For example, instead of folding the web of film and then inserting and joining string zipper material between opposing web portions, one side of the string zipper material could be joined to the film, the film is then folded, and thereafter the other side of the string zipper is joined to a confronting portion of the folded web. Alternatively, respective flangeless zipper strips could be joined in parallel to an unfolded web, the web is then folded along a centerline, and the zipper strips are interlocked after folding. Instead of starting with a single web that is folded, one could begin with two webs, only one of which is folded to form the flap at the tops of the bags. The opposing bottoms of the two webs could be sealed together to form the bottoms of the bags. The use of two webs would again entail the three variations of: (1) placing the string zipper between the webs and sealing the sides of the zipper to the respective webs; (2) sealing one side of the string zipper to one web, placing the other web in opposing relationship, and then sealing the other side of the string zipper to the other web; and (3) sealing one flangeless zipper strip to one web, sealing the other flangeless zipper strip to the other web, and then interlocking the zipper strips while attached to the respective webs.

In accordance with yet another variation, the top flap on the reclosable bag could be made by attaching a separate strip or web of film to a second web that is folded or joined to a third web and then cross sealed to form the receptacles. Two such variations are depicted in FIGS. 6 and 7.

Figure 6:
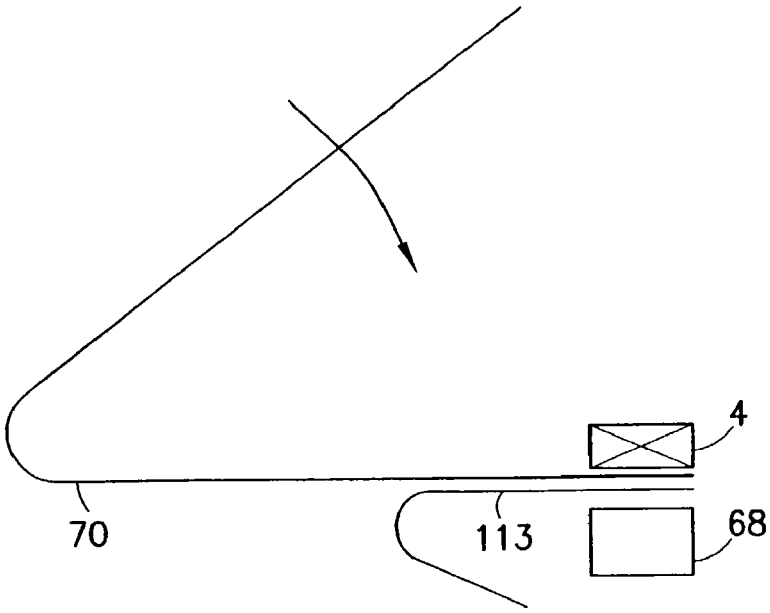
FIGS. 6 and 7 are drawings showing alternative methods of manufacture in accordance with other embodiments of the invention.

As seen in FIG. 6, a web 70 of film is folded and then one side of a string zipper 4 is joined to a marginal portion of the web 70 by a heated sealing bar 68. Before this sealing operation, however, a marginal portion of a second web 113 is interposed between the aforementioned marginal portion of the web 70 and the sealing bar 68. As a result, both webs 70 and 113 are sealed to one side of the string zipper 4 during this sealing operation, thereby forming a merged double layer of film. The web 70 is then folded and the other marginal portion thereof is joined to the other side of the string zipper 4. Thereafter, a slider is inserted onto the string zipper (not shown in FIG. 6). The end result is the same structure depicted in FIG. 3.

Figure 7:
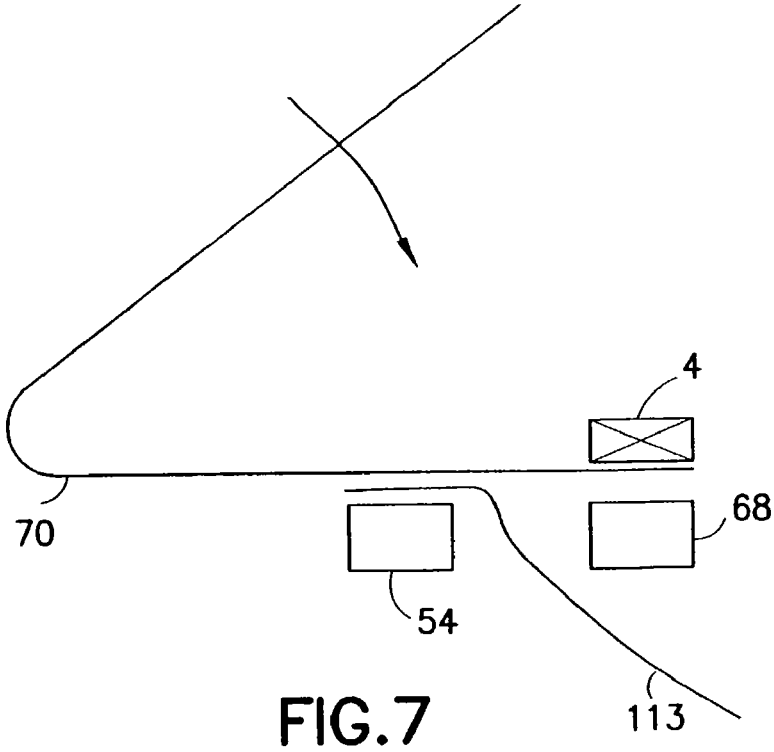

FIG. 7 shows a variation of the method depicted in FIG. 6. In this example, a marginal portion of the web 113 is joined, e.g., by a heated sealing bar 54, to a portion of web 70 that is displaced from the marginal portion of web 70 where zipper 4 is attached.

In all cases, the web 113 must have a sufficient width that it will form a flap (see item 112 in FIG. 1) in the completed bag that extends above the string zipper. In all methods involving the sealing of separate webs of film, separate unwinding and tension control must be provided for the respective webs.

The invention does not require that the slider have a plow or separating finger. The slider-zipper assembly could be designed so that the side walls of a straddling slider cam the zipper open without the aid of a plow or separating finger when the slider is moved in an opening direction.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions.

What is claimed is:

1. A reclosable bag comprising:

a zipper comprising first and second zipper strips, said first zipper strip comprising a first base and a first closure profile projecting from said first base, and said second zipper strip comprising a second base and a second closure profile projecting from said second base and engaged with said first closure profile;

a film structure made of a film material, said film structure comprising first and second portions integrally connected to one side of a third portion, said third portion being a double layer of said film material, and said first and second portions each being a respective single layer of said film material, said first zipper strip being joined to said first portion of said film structure, and said second zipper strip being joined to said third portion of said film structure; and a slider mounted on said zipper and movable in opposite directions for opening and closing said zipper, wherein at least part of said third portion of said film structure is disposed between said second base of said second zipper strip and one side of said slider.

2. The bag as recited in claim 1, wherein the part of said first portion that is joined to said first base of said first zipper strip is disposed between said first base and the other side of said slider.

3. The bag as recited in claim 1, further comprising a fold integrally connecting said second and third portions of said film structure.

4. The bag as recited in claim 1, wherein said third portion of said film structure is formed by merging two single layers of said film material together.

5. The bag as recited in claim 1, wherein said second portion of said film structure comprises first and second discontinuities.

6. The bag as recited in claim 5, wherein said discontinuities are holes.

7. The bag as recited in claim 5, wherein said discontinuities are slits.

8. The bag as recited in claim 1, wherein said second portion of said film structure comprises a line of weakened tear resistance.

9. The bag as recited in claim 5, wherein said second portion of said film structure further comprises a line of weakened tear resistance disposed so that the part of said second portion having said first and second discontinuities can be severed from the remainder of said second portion by tearing along said line of weakened tear resistance.

10. The bag as recited in claim 1, wherein said first portion of said film structure is folded, and opposing edges of said first and third portions of said film structure are joined to form a receptacle having a mouth, said zipper being installed in said mouth.

11. A reclosable bag comprising:

a receptacle comprising first and second walls joined at their sides, said first and second walls comprising respective upper marginal portions that form a mouth at a top of said receptacle;

a string zipper comprising mutually interlockable first and second zipper strips respectively joined to said upper marginal portions of said first and second walls;

a slider mounted on said string zipper and movable in opposite directions for opening and closing said string zipper, said upper marginal portion of said first wall being disposed between said first zipper strip and a first portion of said slider, and said upper marginal portion of said second wall being disposed between said second zipper strip and a second portion of said slider; and a web comprising a first portion joined with at least said upper marginal portion of said first wall and disposed, at least in part, between said first zipper strip and said first portion of said slider, and a second portion that is integrally formed with and extends from said first portion of said web without being joined to any other part of the bag, said second portion of said web extending downward in immediate proximity to where said first and second portions of said web are integrally formed and having sufficient length to wrap around a bottom edge of said first portion of said slider to a position whereat a distal edge of said second portion of said web is disposed at an elevation higher than said bottom edge of said first portion of said slider.

12. The bag as recited in claim 11, wherein said length of said second portion of said web is sufficient to wrap said second portion around said first portion of said slider to a position whereat said distal edge of said second portion of said web is disposed at an elevation higher than a top of said string zipper.

13. The bag as recited in claim 11, wherein said first and second walls and said web are made of the same material.

14. The bag as recited in claim 11, wherein undeformed portions of said first and second walls and said second portion of said web have the same thickness.

15. The bag as recited in claim 11, wherein said second portion of said web comprises first and second holes.

16. The bag as recited in claim 11, wherein said second portion of said web comprises first and second slits.

17. The bag as recited in claim 11, wherein said second portion of said web comprises a line of weakened tear resistance.

18. The bag as recited in claim 17, wherein said line of weakened tear resistance comprises a series of spaced perforations.

19. The bag as recited in claim 17, wherein said line of weakened tear resistance comprises a scoreline.

20. The bag as recited in claim 17, wherein said line of weakened tear resistance extends across substantially the entire length of said second portion of said web.

21. The bag as recited in claim 11, wherein said second portion of said web has a width substantially equal to a width of said first wall.

22. The bag as recited in claim 11, wherein said first portion of said web is merged with said upper marginal portion of said first wall.

23. A reclosable bag comprising:

a receptacle made of a film material and having a mouth comprising first and second sides, said first side of said mouth consisting of a double thickness of the film material;

a zipper comprising first and second zipper strips respectively joined to said first and second sides of said mouth;

a slider mounted on said zipper and movable in opposite directions for opening and closing said zipper; and a flap connected to said first side of said mouth of said receptacle and made of a single thickness of the film material, the portion of said flap adjacent the connection with said first side of said mouth extending downward and said flap having a length sufficient to allow the rest of said flap to be wrapped around at least the bottom of one side of said slider, said flap comprising a discontinuity and a line of weakened tear resistance that traverses an area disposed between said discontinuity and said connection with said first side of said mouth.

24. The bag as recited in claim 23, wherein said second side of said mouth comprises a single thickness of the film material.

25. The bag as recited in claim 24, wherein said discontinuity comprises a hole or a slit.

26. The bag as recited in claim 25, wherein said line of weakened tear resistance comprises spaced perforations or a scoreline.

27. The bag as recited in claim 23, wherein said discontinuity is disposed above said zipper when said flap is wrapped around said slider and extended fully upward.

* * * * *